United States Patent [19]

Spatz

[11] 4,147,280

[45] Apr. 3, 1979

[54] PUMP DEVICE FOR DISPENSING FLUIDS

[75] Inventor: Walter B. Spatz, Pacific Palisades, Calif.

[73] Assignee: Spatz Corporation, Santa Monica, Calif.

[21] Appl. No.: 752,105

[22] Filed: Dec. 20, 1976

Related U.S. Application Data

[63] Continuation of Ser. No. 597,829, Jul. 21, 1975, abandoned.

[51] Int. Cl.[2] ..... B05B 11/00

[52] U.S. Cl. ..... 222/179.5; 222/321; 222/340; 222/380; 222/381

[58] Field of Search ..... 222/321, 340, 182, 179.5, 222/381, 380; 239/329, 331, 333

[56] References Cited

U.S. PATENT DOCUMENTS

| | | | |
|---|---|---|---|
| 1,383,379 | 7/1921 | Blain | 222/390 X |
| 1,676,358 | 7/1928 | Schott | 222/340 |
| 1,730,684 | 10/1929 | Phillips | 222/321 |
| 2,031,172 | 2/1936 | Maloney | 222/182 |
| 3,471,065 | 10/1969 | Malone | 222/340 X |
| 3,777,945 | 12/1973 | Nozawa et al. | 222/394 |
| 3,792,800 | 2/1974 | Capra et al. | 222/340 X |
| 3,797,748 | 3/1974 | Nozawa et al. | 239/324 X |

*Primary Examiner*—Robert J. Spar
*Assistant Examiner*—Frederick R. Handren

[57] ABSTRACT

A device for dispensing fluids employs a manually actuated pump mounted in the neck of a conventional container. The pump includes a stationary piston and a shiftable cylinder which form a pump chamber. The piston includes a check valve which controls the fluid inlet to the pump chamber. The cylinder is spring biased in a direction which pressurizes the fluid in the pump chamber. An upwardly extending neck of the cylinder is exteriorly threaded and carries a discharge valve. A cap which fits over the container neck, cylinder neck and discharge valve has an internally threaded tubular portion which can be engaged with the thread on the cylinder neck. The cap can be turned with the threads engaged to lift the cylinder against the bias of the spring and draw fluid into the pump chamber. With the cap removed, the discharge valve can be opened to allow fluid in the pump chamber to flow through the cylinder neck and exit from the discharge valve.

14 Claims, 5 Drawing Figures

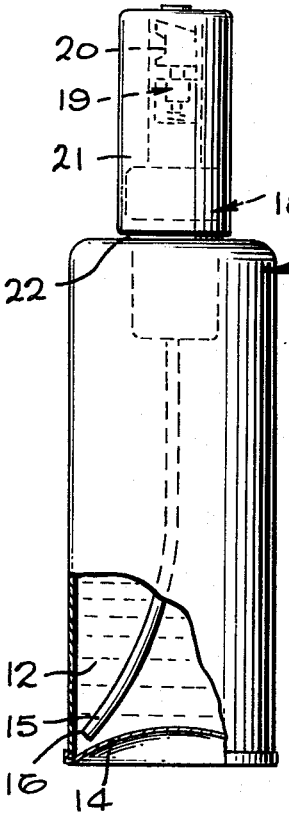
Fig. 1
Fig. 2
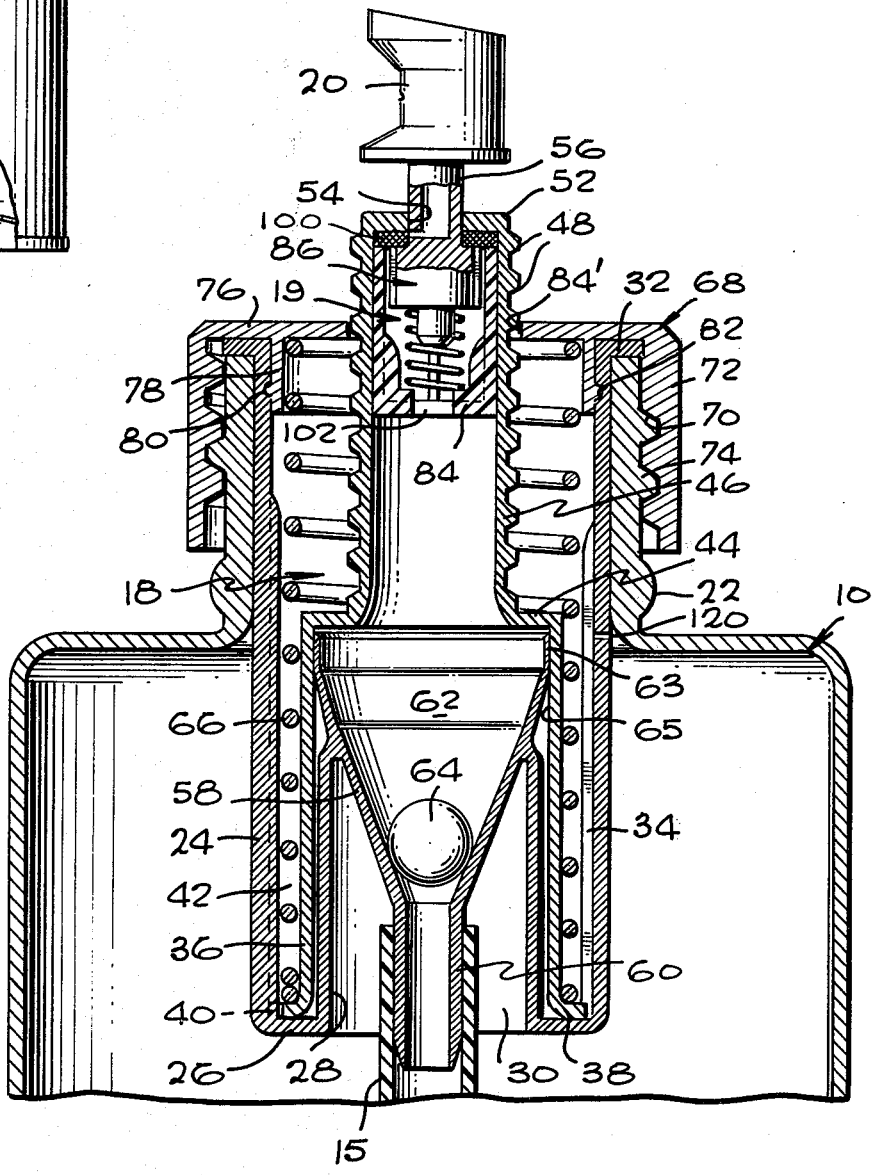

PUMP DEVICE FOR DISPENSING FLUIDS

This is a continuation of application Ser. No. 597,829, filed July 21, 1975, now abandoned.

This invention relates to a device for dispensing a fluid from a container, particularly for dispensing fluids from conventional or standard bottle-type containers, and is particularly designed for dispensing a fluid from a conventional container, e.g., a plastic bottle, without requiring the use of an aerosol propellant.

In modern methods of application of a host of fluids such as oven cleaners, furniture polishes, hair spray, perfumes, and the like, these fluids are packaged in so-called aerosol containers, employing conventional aerosol propellants under pressure, e.g., of the order of about 25 lb./sq. in. Such aerosol container packages for application of all types of fluids, as exemplified above, have wide usage. However, the requirement of an aerosol propellant to provide dispensing pressure is expensive and dangerous, due to possible leakage of propellant gas from the container, possible explosion of the container during storage, and also accidental piercing, incineration or inhalation of propellant fumes. Hence the replacement of aerosol propellant and substitution of an inexpensive means for supplying energy to discharge or spray the contents of a bottle-type container, as desired, and avoiding the relatively hazardous use of a gas propellant for this purpose is highly desirable.

According to the present invention, the above object is achieved by having the user store energy in an energy storing means, such as a spring, during the act of replacing the cap on the container. Removal of the cap preparatory to use releases such stored or potential energy so that upon operation of the dispensing actuator, as by pressing same, small volumes of fluid are dispensed, as is done in the case of many types of aerosol packaged fluids such as perfumes, deodorants and hair sprays, or larger volumes can be dispensed, as desired, and as will be apparent from the preferred embodiment of the invention described in detail below. Thus, it is unnecessary to have potential energy stored which is sufficient to empty the entire container, as is the case when employing a gas propellant in conventional aerosol packages, and the user supplies this energy, more or less unwittingly, as required, when placing or engaging the cap on the container, as previously pointed out.

In accordance with one embodiment, the novel pump means or device, according to the invention, which replaces the aerosol propellant in conventional aerosol packages, comprises a pump chamber including a piston, a resilient means, for example a compression spring, associated with the pump chamber and piston, and a cover engaging means connected to such pump chamber and piston, the pump chamber communicating with a conventional dip tube for discharging the contents of the container, with suitable valve means regulating the flow of fluid from such tube and into the pump chamber. The pump means also carries conventional discharge valve means communicating with the pump chamber.

According to preferred practice the cover engaging means of the pump of the invention, comprises a threaded member which can be engaged with a mating threaded member connected to the cap, so that when the cap is screwed onto the threaded engaging means of the pump, the resilient means, for example in the form of a compression spring, is compressed, storing potential energy, and when the cap is removed just prior to use, such stored energy can be used to actuate the piston and force fluid contained in the pump chamber out of the discharge nozzle when the actuator is pressed to open such nozzle. During replacement of the cap and further compression of the spring as result thereof, additional fluid is permitted to flow through the dispensing tube and into the pump chamber.

An important feature of the present invention is that after the contents of the container have been fully dispensed, the pump of the invention is removable from the container for placement onto another full container.

The invention will be understood more clearly in connection with the description below of a preferred embodiment, taken in connection with the accompanying drawing wherein:

FIG. 1 illustrates a conventional container or bottle, which is provided with a fluid dispensing pump according to the invention, the lower portion of the container being broken away to show the dispensing tube;

FIG. 2 is a sectional elevation of the pump means of the invention mounted on the neck of a conventional bottle of the type illustrated in FIG. 1, prior to placement of the cap thereon, and also showing the conventional valve discharge components and dispensing actuator;

Figure 3:
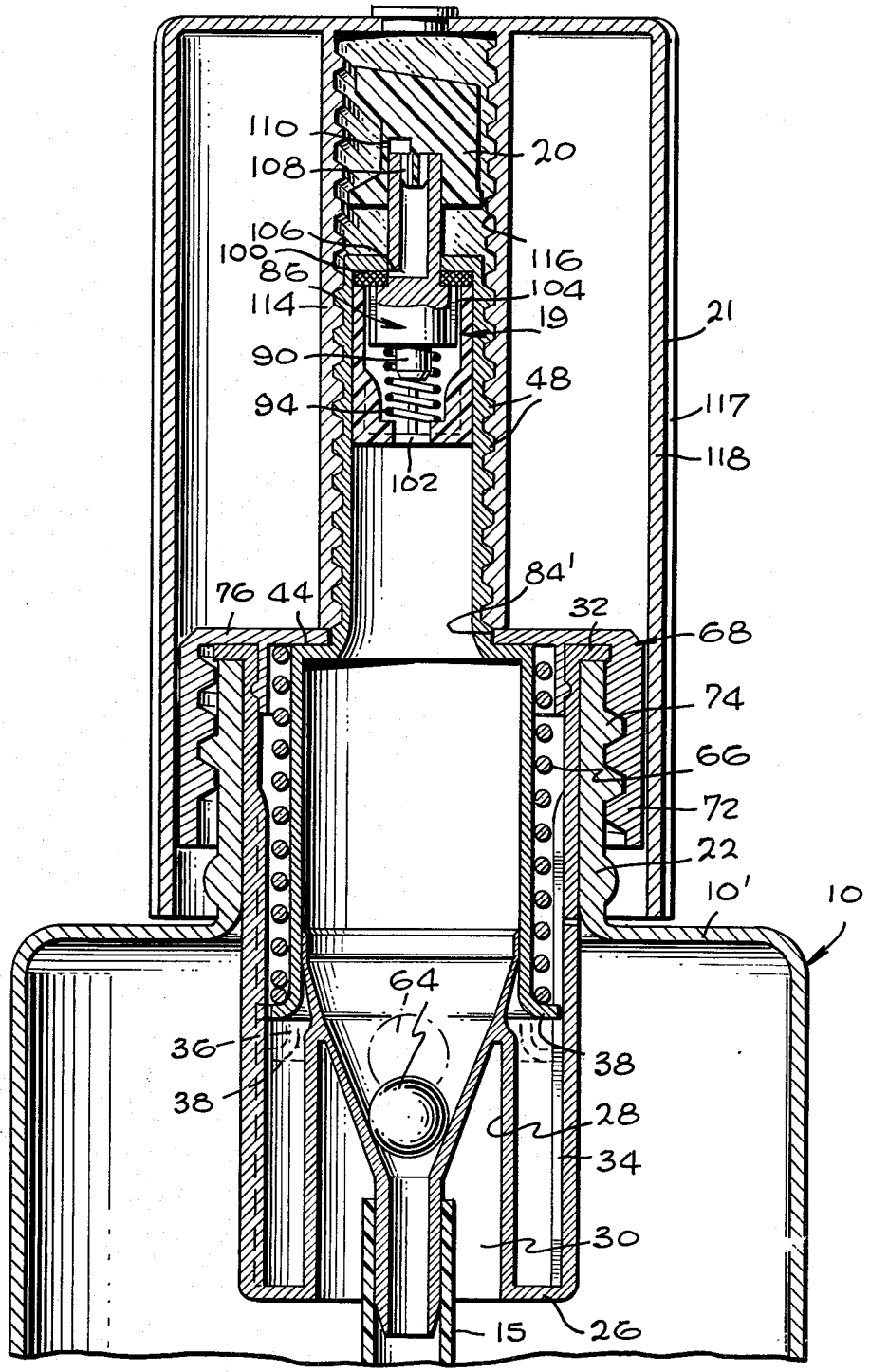
FIG. 3 is a sectional elevation similar to FIG. 2, but showing the cap positioned on the bottle and engaged with the pump.

Referring to FIG. 1 of the drawing, numeral 10 represents a conventional form of container, preferably in the form of a plastic bottle, containing a fluid, such as a perfume, hair spray or furniture polish fluid, indicated at 12, to be dispensed. Such container or bottle is conventionally concavely dished at the bottom, as illustrated at 14, and is provided with a fluid dispensing dip tube 15 which is curved at its lower end and designed to terminate at the extreme lower end of the container adjacent the side wall, as at 16, in order to dispense the maximum volume of fluid contained in the bottle. The upper end of the tube 14 is connected to the pump of the invention, indicated in dotted lines at 18, for dispensing the contents of the container, as desired, by means of conventional valve components indicated at 19 connected to the upper end of pump 18, and terminating in the conventional finger-operated actuator, indicated in dotted lines at 20, for discharge of fluid, as desired, from the container, such pump 18 and related components for dispensing fluid from the container being described in detail below. A cover 21 is adapted to be placed over the pump 18, the valve components 19 and actuator 20.

Figure 4:
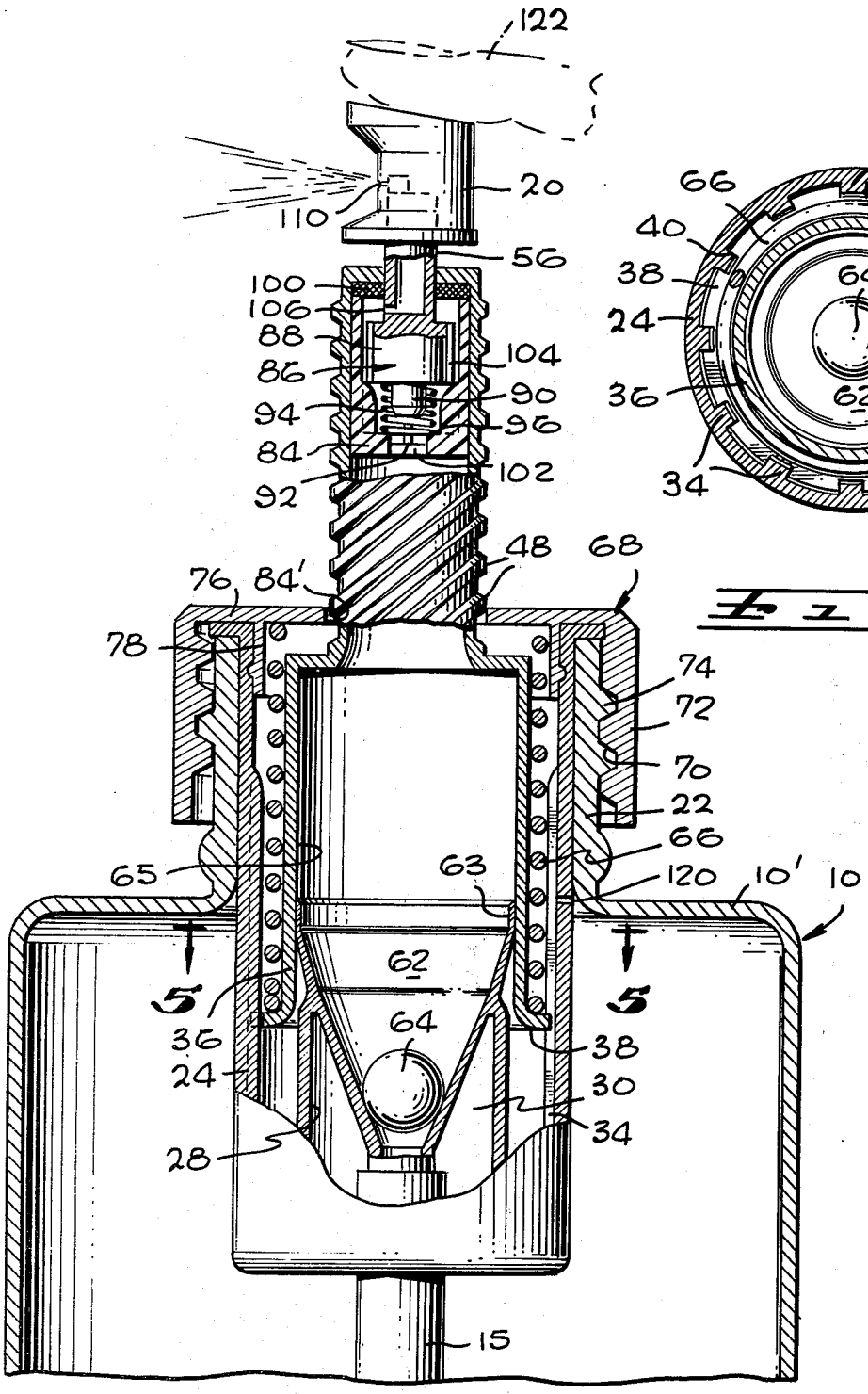
FIG. 4 is a sectional elevation similar to FIG. 3 following removal of the bottle cap, and showing the position of the compression spring and resulting movement of the spring actuated member of the pump, upon discharge or dispensing a portion of fluid by pressing the dispensing actuator.

Now referring to FIGS. 2–4 of the drawing, pump 18 of the invention is mounted on the neck 22 of container 10, and comprises an outer cylindrical housing 24 having an annular bottom 26 and an upwardly extending inner circular wall 28, forming a cylindrical chamber 30, into which the upper end of dip tube 15 extends. The upper end of the outer housing 24 is provided with an integral outwardly extending horizontal flange 32 which rests on the upper edge of the neck 22 of container 10, thereby supporting the housing 24 on the container, with the lower portion thereof extending downwardly into the upper end of the bottle or container 10.

Figure 5:
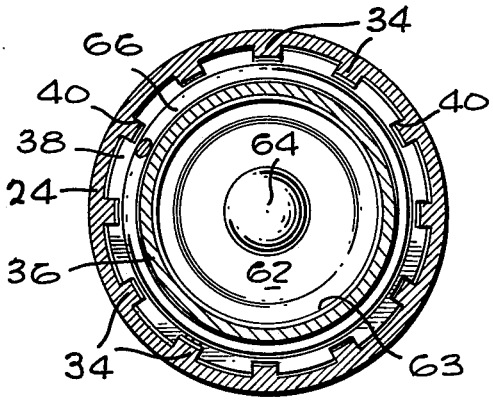
FIG. 5 is a horizontal section taken on line 5—5 of FIG. 4.

As best seen in FIG. 5, the interior wall of the pump housing 24 is provided with a series of longitudinally extending circumferentially equally spaced parallel splines 34 shown as 12 in number in FIG. 5. A hollow cylinder or fluid pressure applying structure 36 is positioned within the pump housing 24 and designed for longitudinal movement within the housing 24, such cylinder carrying at its lower end an integral outwardly extending horizontal circular flange 38, the outer edge of flange 38 being in slidable engagement with the inner surface of the housing 24, and being guided only for longitudinal non-rotational movement within housing 24 by provision of a series of grooves 40 which are equally spaced around the periphery of flange 38, the number of such grooves being equal to the number of splines 34, said grooves 40 mating with the respective splines 34. Cylinder 36 is disposed in the annular space 42 provided between outer housing 24 and the inner wall 28 of the housing, and extends upwardly in the pump housing and having at its upper end an inwardly extending horizontal shoulder 44, to which is connected an upwardly extending axially disposed neck 46, provided with relatively steep external threads 48, for engagement with the cover 21, as pointed out in further detail below.

Within the upper end of the neck 46 is mounted the conventional aerosol dispensing mechanism or components, indicated generally at 19, described in detail hereinafter, the upper end of neck 46 and the dispenser mechanism 19 being covered by the cover member 52 connected to the upper end of neck 46, and containing a central opening 54 which receives a hollow stem or plunger 56 for slidable longitudinal movement within opening 54, which is actuated by the finger actuator 20 connected in a suitable manner to the stem 56, as by press fit thereon.

The upper end of the inner wall 28 of pump housing 24 carries an integral conical portion or piston 58 which terminates at its lower end in an axially disposed tubular member 60 which is designed to fit snugly within the upper end of tube 15, to provide fluid communication between the interior of container 10 and the pump chamber 62. The upper end of the conical member 58 carries a lip seal 63 which maintains slidable fluid sealing engagement with the inner surface 65 of the cylinder 36. A ball check valve 64 is positioned at the lower end of the conical piston portion 58 permitting passage of fluid from the interior of container 10, via tube 15 and tubular portion 60, into pump chamber 62, but preventing flow of fluid in the opposite direction, that is from pump chamber 62 back to the interior of the container, via tube 15.

The cylinder 36, and including the threaded neck 46 and dispenser mechanism 19 and actuator 20 carried thereon, are normally biased in the extreme downward position, with the bottom flange 38 adjacent the bottom 26 of the pump housing, as illustrated in FIG. 2, by means of a compression spring 66 disposed in the annular space 42, and resting at its lower end against flange 38, and compressed at its upper end against the inner surface of a cylindrical cap 68. Cap 68 rests on the upper flange 32 of the pump housing and is designed to securely position the pump 18 and its associated elements including the dispenser mechanism 19 and the actuator 20 in fixed position on the neck 22 of the container. Thus, after the pump 18 and its above-noted associated elements including spring 66 have been inserted into the neck of the container, with the flange 32 resting on the upper edge of the neck of the container, an interior cap 68, having internal threads 70 on the depending portion 72 of the cap, is engaged with mating external threads 74 on the neck 22 of the container, and the cap 68 is screwed down onto the neck 22 until the top 76 of the cap engages the upper flange 32 on the pump housing 24.

It will be noted that the top 76 of cap 68 carries on its lower surface a depending circular flange 78 having an outer diameter approximately equal to the inside diameter of the pump housing 24, such flange carrying on its external surface adjacent the lower end thereof, a bead 80 which snaps into a peripheral groove 82 around the upper interior surface of the housing 24, thereby locking the cap 68 over the pump housing and maintaining pump 18 and its associated elements including the dispenser mechanism 19 and attached actuator member 20, together, to facilitate shipment of such assembly to the filler source or manufacturer, for mounting such assembly on the container or bottle after filling thereof. The connection of cap 68 with pump housing 24 by means of the bead 80, resists spring 66, the upper end of which is compressed against the lower surface of the top 76 of the cap and adjacent the inner surface at the upper end of depending flange 78. Cap 68 has an opening 84' in the center thereof to permit passage of the cap over actuator 20 and down around the externally threaded neck 46 for threaded engagement of cap 68 with the neck 22 of the container, as described above.

The dispenser mechanism 19 positioned in the upper end of the exteriorly threaded neck 46 of the pump cylinder comprises an outer housing 84 containing a spring biased valve 86 connected at its upper end to plunger 56 for operation of the valve by pressure applied by the finger of the user to the actuator 20. The valve 86 comprises a cylindrical body portion 88 having a diameter somewhat smaller than the inner diameter of the housing 84, permitting slidable longitudinal movement of the body member 88 with respect to the fixed housing 84. Connected to the lower end of body member 88 is a depending axially positioned pin 90. A compression spring 94 is disposed axially around pin 90, the lower end of spring 94 abutting an annular shoulder 96 adjacent the bottom of housing 84, and the upper end of spring 94 abutting the lower surface of the body member 88. An annular fluid seal 100 is fixed to the upper end of dispenser housing 84, and in the normal position of the dispenser mechanism 19, the compression spring 94 biases the body member 88 of the valve 86 in fluid-tight sealing engagement with the seal 100, as seen in FIG. 3.

A fluid port 102 is provided in the lower end of the dispenser housing 84, communicating the interior of the neck 46 with the interior of the housing 84, and the body member 88 is provided with peripheral longitudinal grooves forming fluid passages 104. The plunger 56, which is in the form of a hollow stem, has an inlet port 106 at the lower end, the upper end of the hollow plunger 56 having a passage 108 communicating with a discharge nozzle 110 for discharging fluid in the form of a spray when the actuator 20 is depressed by the finger of the user to the position illustrated in FIG. 4.

The dispenser mechanism 19, and its associated components, including chiefly elements 20, 56, 84, 88, 94 and 100, and fluid passages formed therein, as noted above, is a conventional mechanism well known in the aerosol dispenser art, and such mechanism per se forms no part of the present invention.

As seen in FIG. 3, a cap or cover 21 is provided which is designed to fit over and around actuator 20 containing spray nozzle 110, the upwardly extending neck 46 containing the dispenser mechanism 19, and the interior cap 68 positioned around the neck 22 of the container. Cap 21 carries a depending axially positioned circular sleeve 114 which is internally threaded at 116 for mating engagement with the external threads 48 on the upwardly extending neck 46 connected to pump cylinder 36. The exterior surface of the depending portion 118 of cap 21 is provided with longitudinally extending spaced ribs 117 to add strength to the side wall 118 of the cover. As illustrated in FIG. 3, when the internally threaded sleeve 114 of cover 21 is turned down onto the externally threaded neck 46, to the position illustrated in FIG. 3, so that the cover is turned down to its lowermost position, the lower end of the cover sleeve 114 is in contact with the upper surface of the interior cap 68, and the lower end of the outer depending portion 118 of the cover is disposed just above the upper shoulder 10' of the container. As previously noted, the mating threads 48 and 116 on members 46 and 114, respectively, for example can be in the form of steep threads, so that only about one turn of the cap 21 is required to completely engage the neck 46 along the length thereof and place such cap in its lowermost position as seen in FIG. 3. It will be noted that when the cover is placed over the container and in threaded engagement with the neck 46, the actuator 20 is received in the interior of the flange 114.

It will be seen that when the cap 21 is screwed onto the neck 46, this action will raise the neck 46 and the pump cylinder 36 connected to the lower end of the neck, from the lowermost position of the cylinder as seen in FIG. 2, to its uppermost position as seen in FIG. 3, against the action of the compression spring 66. This action will increase the volume of pump chamber 62 from that shown in FIG. 2, to the volume shown in FIG. 3. In the uppermost position of cylinder 36, as seen in FIG. 3, shoulder 44 of the cylinder is in engagement with the interior surface of the top 76 of cap 68.

The pump housing 24 is provided with an aperture 120 to permit entry of air into the interior of container 10.

All of the components of the pump mechanism 18 of the invention and its associated dispenser mechanism 19, can be formed of any suitable material such as metals or plastics, and most economically are formed of suitable plastics such as injection molded components of acetal resins, polypropylene, and the like, for this purpose.

After the pump 18 of the invention and its associated dispenser mechanism 19 are mounted on the neck of a container whose contents are to be dispensed, in the manner described above, and with cap 21 removed, the pump chamber 62 is first filled with fluid or liquid from the container by depressing the actuator 20 so that the pumping chamber 62 can be vented during priming. The pump is primed and operable either by attaining a liquid level in the pump chamber 62 at least equal to the level of the liquid in the container, or by displacing liquid in the container and forcing it up the dip tube 15.

The pump mechanism can then be placed into operative position for dispensing fluid by placing cap 21 on the container, that is by screwing the threaded sleeve portion 114 of the cap onto the threaded neck 46. As previously noted, this action raises the pump cylinder 36 and compresses the spring 66, as shown in FIG. 3. It will be noted that during the raising of the pump cylinder 36 by replacement of the cap, the pump cylinder 36 does not rotate because of the splined connection between the flange 38 and the interior wall of the pump housing 24.

Further, it will be noted that when the cap is screwed onto the top of the pump at 46, and the pump piston 36 is raised, due to reduced pressure in the pump chamber 62, fluid flows from the dip tube 15, through the tube portion 60 of the conical member 58 and past the ball check 64 into the pump chamber 62 and neck 46 to displace the increased volume provided as result of the raising of the pump cylinder 36 and its associated neck portion 46. When the pump chamber 62 and neck 46 are filled with liquid, which occurs at the top of the stroke of the cylinder 36, ball check 64 drops back from the dotted line position shown in FIG. 3, to prevent fluid flow from the pump chamber 62 back into the container 10. Retention of liquid in the pump chamber 62 does not depend solely upon the return of the ball check valve 64 to its full line position shown in FIG. 3, but also the valve mechanism 86 of the dispenser 19 remains closed and prevents ingress of air and insures retention of liquid in the pump chamber. Thus, in the position shown in FIG. 3 with the pump chamber 62 now filled with liquid from the container, the compressed spring 56 biases pump cylinder 36 downward. Thus it is seen that the placement of the cap 21 on the container in association with the pump mechanism 18, as described above, stores potential energy in compression of the spring 66 during such cap replacement.

When the user wishes to dispense fluid from the container, the cap is then removed, such cap removal inducing pressure applied by spring 66 and the associated cylinder 36, against the head of liquid in the pump chamber 62. The user then presses the finger indicated at 122 in FIG. 4 downward on the actuator 20, depressing the plunger 56 against the action of the spring 94, and the pressure induced by compression spring 66 against the liquid in chamber 62, together with the additional pressure on such fluid induced by depression of the body member 88, will force liquid contained in the pump chamber 62 and in neck 46, through port 102, passages 104 and the space 124, provided by the depression of the body member 88, and through port 106, hollow stem 56, passage 108 and nozzle 110, causing the fluid to be discharged as a spray from the nozzle. In effect the spring biased piston 36 functions and applies pressure against the body of liquid within neck 46. As fluid is displaced from the neck 46 and pump chamber 62 by dispensing thereof through the nozzle, such fluid displacement will cause the pump cylinder 36 to be lowered, by the action of the compression spring 66. Thus, a relatively short burst of spray from the nozzle 110 may lower the cylinder 36 and its associated flange 38 to the position shown in FIG. 4, corresponding to the dotted line position of such piston and flange shown in FIG. 3. A series of short bursts or discharges of fluid can be readily attained, each such discharge thus lowering the position of the pump cylinder 36 and its flange 38 until the final discharge lowers such pump cylinder and flange to its lowermost position as shown in FIG. 2. Alternatively, longer continuous bursts of fluid can be achieved, or if desired one continuous fluid discharge can be made, during which time the pump cylinder will continuously lower from its uppermost position shown in FIG. 3 to its lowermost position shown in FIG. 2. Thus, the pump capacity for a series of bursts or discharges, or for one continuous discharge without replacing the cover, corresponds to the volume of liquid displaced when the cylinder 36 travels from its uppermost position in FIG. 3 to its lowermost position shown in FIG. 2.

The cap 21 can be replaced after any period of usage, and regardless as to the amount of fluid discharged during the previous use, and the corresponding position of the pump cylinder 36 and its associated flange 38 from a position adjacent its uppermost position shown in FIG. 3 or any intermediate position such as the dotted line position thereof shown in FIG. 3, or its lowermost position as shown in FIG. 2, such full replacement of the cap as shown in FIG. 3 will again raise the pump cylinder 36 and its associated flange 38 to its uppermost position, as seen in FIG. 3, and during such replacement of the cap and the consequent raising of the pump cylinder 36, the reduced pressure in the pump chamber 62 and the expansion of the volume thereof, as result of the raising of the pump cylinder, causes fluid to flow from the container via dip tube 15 and past the ball check 64 into the pump chamber 62, at the same time again compressing the spring 66 by such upward movement and storing energy for discharge of fluid, as described above.

It will be understood of course that the steeper the mating threads 48 and 116 on the neck 46 and the internal sleeve 114 of the cover or cap 21, the fewer turns of the cap 21 will be required to lift the pump cylinder 36, but of course at the same time the requisite torque will be higher. Thus for example a 40° helix angle for these threaded connections is satisfactory.

It will be noted that after the container has been completely emptied, the pump device of the invention can be readily removed from the top of the container by unscrewing the cap 68 and thereby permitting removal of the pump 18 and its associated dispenser mechanism 19, including actuator 20, which assembly can then be replaced on another full container for dispensing liquid therefrom.

Aerosol packages or containers generally have gas propellant at pressures of the order of about 25 lb./sq. in. Such pressures are readily attained by proper design of spring 66. Further, it is noted that finger pressure upon actuator 20 is added to the pressure exertd by spring 66. Hence the pump device of the invention can be designed to substantially simulate the performance employing conventional aerosol propellants. Thus, the invention device can be designed to readily emit a total 15 second period of discharge, which readily permits application of the invention pump device for dispensing containers containing oven cleaners or furniture polishes, for example. For perfumes, deodorants, hair sprays, and the like, a 3–5 second blast generally is sufficient, and several of such blasts can be provided before the cap need be replaced to again provide energy for fluid discharge.

In place of a compression spring such as 66 for supplying potential energy during cap replacement to operate pump cylinder means such as cylinder 36, for dispensing liquid from a container according to the invention, equivalent cylinder activating means can be employed. Such equivalent means can be, for example a tension spring, which can be fastened at one end to the lower surface of flange 38 and at its lower end to the bottom 26 of pump housing 24. Alternatively other resilient or elastic means for suitably biasing the pump cylinder according to the invention can be used.

It is accordingly seen that the invention provides a mechanism for readily dispensing fluids from containers, and which replaces expensive and dangerous gas propellants widely employed in aerosol-type containers for dispensing various types of fluids, and which mechanism has the additional virtues of being inexpensive and reusable.

I claim:

1. A fluid dispensing device, comprising a container for the fluid adapted to be held in a person's hand, pump means mounted in said container including a housing fixed to said container and a cylinder in said housing shiftable with respect to said housing and container, said cylinder having a pump chamber therein and an external thread, means providing a slidable spline connection between the lower end of said cylinder and said housing to prevent rotation of said cylinder in said housing, said pump means including a member fixed in said container and disposed in said chamber in slidable sealed relation to said cylinder, spring means in said housing surrounding said cylinder and bearing against said lower end of said cylinder to shift said cylinder and its chamber in one direction with respect to said member to cause said cylinder to apply pressure to fluid in said chamber, a first valve means permitting fluid flow from said container into the lower end of said chamber, but preventing reverse fluid flow, an internally threaded actuator threadedly engaged with said external thread and rotatable with respect to said cylinder to store potential energy in said spring means and to effect fluid flow through said first valve means into said chamber, and a second valve means operable by a finger of the hand holding said container to permit discharge of pressurized fluid from said pump chamber and through said cylinder in response to shifting of said cylinder and its chamber in said one direction by said spring means.

2. A device as defined in claim 1; said threads being steeply pitched.

3. A device as defined in claim 1, said second valve means being mounted on said cylinder and controlling flow of fluid through said cylinder.

4. A device as defined in claim 1, said cylinder having a visible portion extending upwardly beyond said container to provide an indication of the fluid volume in said pump chamber.

5. A device is defined in claim 1; said slidable spline connection comprising circumferentially spaced longitudinal splines in said housing, said cylinder having a grooved flange at its lower end mating with said splines.

6. A fluid dispensing device, comprising a container for the fluid, pump means mounted in said container, said pump means including a fluid pressure applying structure shiftable with respect to said container and having a pump chamber therein, resilient means for shifting said fluid pressure applying structure and its chamber in one direction to cause said fluid pressure applying structure to apply pressure to fluid in said chamber, a first valve means permitting fluid flow from said container into said chamber but preventing reverse fluid flow, means for energizing said resilient means including an actuator rotatable with respect to said fluid pressure applying structure and container, said energizing means further including means interconnecting said actuator and fluid pressure applying structure to effect shifting of said fluid pressure applying structure and its chamber in the opposite direction in response to rotation of said actuator relative to said fluid pressure applying structure and container to store potential energy in said resilient means and to effect fluid flow through said first valve means into said chamber, and a second valve means operable to permit discharge of pressurized fluid from said pump chamber in response to shifting of said fluid pressure applying structure and its chamber in said one direction by said resilient means; said actuator comprising a removable enclosure interconnected by said interconnecting means with said fluid pressure applying structure to enclose said second valve means.

7. A fluid dispensing device, comprising a container for the fluid, pump means mounted in said container, said pump means including a fluid pressure applying structure shiftable with respect to said container and having a pump chamber therein, resilient means for shifting said fluid pressure applying structure and its chamber in one direction to cause said fluid pressure applying structure to apply pressure to fluid in said chamber, a first valve means permitting fluid flow from said container into said chamber but preventing reverse fluid flow, means for energizing said resilient means including an actuator movable with respect to said fluid pressure applying structure, said energizing means further including means interconnecting said actuator and fluid pressure applying structure to effect shifting of said fluid pressure applying structure and its chamber in the opposite direction in response to movement of said actuator relative to said fluid pressure applying structure to store potential energy in said resilient means and to effect fluid flow through said first valve means into said chamber, and a second valve means operable to permit discharge of pressurized fluid from said pump chamber in response to shifting of said fluid pressure applying structure and its chamber in said one direction by said resilient means; said actuator comprising an enclosure adapted to enclose said second valve means and also to engage said container, said interconnecting means comprising a thread on said enclosure meshing with a thread on said fluid pressure applying structure, whereby rotation of said enclosure on said fluid pressure applying structure, with said enclosure engaging said container, shifts said fluid pressure applying structure longitudinally to energize said resilient means, said enclosure being removable from said fluid pressure applying structure to permit said resilient means to shift said fluid pressure applying structure in said one direction.

8. A device as defined in claim 7, removal of said enclosure from said fluid pressure applying structure also exposing said second valve means, said pump means including a housing disposed within and secured to said container, said fluid pressure applying structure and chamber being disposed in said housing, a member fixed to said housing and disposed in said chamber in slidable sealed relation to said fluid pressure applying structure, said member having an opening into said chamber to permit fluid flowing through said first valve means to pass to said chamber, said resilient means comprising a helical spring engaging said container and said fluid pressure applying structure.

9. A device as defined in claim 7; removal of said enclosure from said fluid pressure applying structure also exposing said second valve means, said pump means including a housing disposed within and secured to said container, said fluid pressure applying structure and chamber being disposed in said housing, a member fixed to said housing and disposed in said chamber in slidable sealed relation to said fluid pressure applying structure, said member having an opening into said chamber to permit fluid flowing through said first valve means to pass to said chamber, said resilient means comprising a helical spring engaging said container and said fluid pressure applying structure, said second valve means being mounted on said fluid pressure applying structure and having a passage communicating with said chamber.

10. A fluid dispensing device, comprising a container for the fluid and having a neck, a pump housing structure in said neck and releasably secured to said neck, a fluid pressure applying structure slidable longitudinally in said housing structure and having a chamber therein, spring means engaging said fluid pressure applying structure and housing structure for shifting said fluid pressure applying structure and its chamber in one direction to cause said piston structure to pressurize fluid in said chamber, an inlet valve in said container permitting fluid flow from said container to said chamber but preventing reverse fluid flow, a discharge valve on said fluid pressure applying structure communicating with said chamber, a removable enclosure adapted to surround said discharge valve and an outer portion of said fluid pressure applying structure, means interconnecting said enclosure and fluid pressure applying structure for shifting said fluid pressure applying structure in the opposite direction to energize said spring means in response to movement of said enclosure with respect to said fluid pressure applying structure, said enclosure being removable from said fluid pressure applying structure to expose said discharge valve for operation and to release said fluid pressure applying structure to permit said fluid pressure applying structure to be shifted by said spring means in said one direction.

11. A device as defined in claim 10; said enclosure bearing against said housing structure while shifting said fluid pressure applying structure in said opposite direction.

12. A device as defined in claim 10; said enclosure bearing against said housing structure while shifting said fluid pressure applying structure in said opposite direction, said interconnecting means comprising a helical thread on said enclosure meshing with a helical thread on said fluid pressure applying structure, whereby rotation of said enclosure with respect to said fluid pressure applying structure while bearing against said housing shifts said fluid pressure applying structure longitudinally in said opposite direction.

13. A device as defined in claim 10; said enclosure bearing against said housing structure while shifting said fluid pressure applying structure in said opposite direction, said interconnecting means comprising a helical thread on said enclosure meshing with a helical thread on said fluid pressure applying structure, whereby rotation of said enclosure with respect to said fluid pressure applying structure while bearing against said housing structure shifts said fluid pressure applying structure longitudinally in said opposite direction, said spring means comprising a helical spring compressed between said housing structure and fluid pressure applying structure.

14. A device as defined in claim 10; a member fixed to said housing structure and disposed in said chamber in slidable sealed relation to said fluid pressure applying structure, said member having an opening into said chamber through which fluid flowing through said inlet valve can pass into said chamber.

* * * * *